US006601358B2

(12) United States Patent
Panatta

(10) Patent No.: US 6,601,358 B2
(45) Date of Patent: Aug. 5, 2003

(54) FLOOR FOR HOUSING AND SUPPORTING EXERCISE EQUIPMENT

(75) Inventor: Rodolfo Panatta, Apiro (IT)

(73) Assignee: Panatta Sport S.r.l., Apiro (IT)

( * ) Notice: Subject to any disclaimer, the term of this patent is extended or adjusted under 35 U.S.C. 154(b) by 4 days.

(21) Appl. No.: 09/880,846

(22) Filed: Jun. 15, 2001

(65) Prior Publication Data

US 2001/0052213 A1 Dec. 20, 2001

(30) Foreign Application Priority Data

Jun. 15, 2000 (IT) ..... BO20A0353

(51) Int. Cl.[7] ..... E04B 1/343
(52) U.S. Cl. ..... 52/508; 52/10; 52/126.5
(58) Field of Search ..... 52/508, 19, 10, 52/126.5

(56) References Cited

U.S. PATENT DOCUMENTS

| | | | | | |
|---|---|---|---|---|---|
| 1,616,198 | A | * | 2/1927 | Partington | 352/88 |
| 3,018,102 | A | | 1/1962 | Murphy | |
| 3,881,724 | A | * | 5/1975 | Beveridge | 273/1.5 R |
| 5,242,174 | A | | 9/1993 | Koole | |
| 5,365,704 | A | * | 11/1994 | Ray | 472/92 |
| 5,718,657 | A | | 2/1998 | Dalebout et al. | |

FOREIGN PATENT DOCUMENTS

| | | | |
|---|---|---|---|
| DE | 10 97 652 B | | 1/1961 |
| DE | 1097652 | * | 1/1961 |

* cited by examiner

*Primary Examiner*—Carl D. Friedman
*Assistant Examiner*—Basil Katcheves
(74) *Attorney, Agent, or Firm*—Birch, Stewart, Kolasch & Birch, LLP

(57) ABSTRACT

An equipped floor having at least one cavity opening outwards and for housing at least one exercise fixture.

8 Claims, 3 Drawing Sheets

FLOOR FOR HOUSING AND SUPPORTING EXERCISE EQUIPMENT

The present invention relates to an exercise or gym floor.

More specifically, the present invention relates to an equipped gym floor for group fitness lessons, in which a group or participants perform a physical exercise program under the guidance and supervision of an instructor.

BACKGROUND OF THE INVENTION

As is well-known, a fitness gym contains a substantially horizontal floor which is provided with a number of exercise fixtures, and is normally used for different types of fitness lessons, each of which may call for either a specific type of fixture, e.g. exercise bikes, treadmills, steppers, or for a specific fixture layout on the floor.

A major drawback of known gyms of the above type lies in the fixtures having to be changed according to the type of lesson, with the unused fixtures being set aside temporarily in a given part of the gym, thus greatly reducing the space available for the lesson. The same also applies to any other type of equipped floor.

Another drawback of known gyms of the above type lies in the fixtures being changed manually, thus complicating organization and involving a good deal of time-consuming work to set up the gym for each lesson.

SUMMARY OF THE INVENTION

It is an object of the present invention to provide an equipped floor designed to eliminate the aforementioned drawbacks.

According to the present invention, there is provided an equipped floor having at least one cavity which opens outwards for housing at least one exercise fixture.

BRIEF DESCRIPTION OF THE DRAWINGS

The present invention will now be described by way of example with reference to the accompanying drawings, wherein.

DETAILED DESCRIPTION OF THE INVENTION

It should be stated that, though the following description substantially refers to a gym, the teachings of the present invention may be applied to advantage to any equipped floor, such as an equipped bathroom floor.

Figure 1:
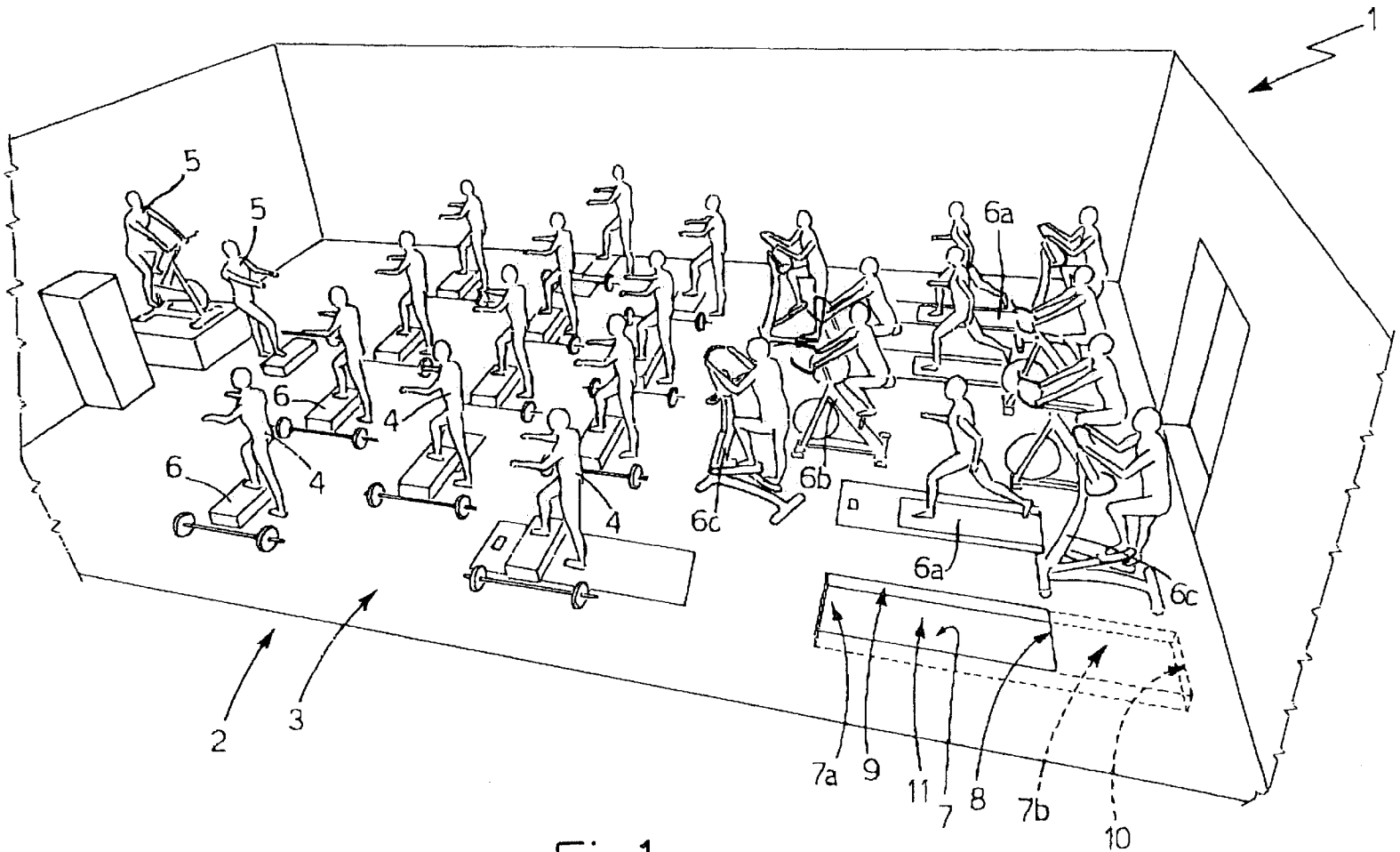
FIG. 1 shows a schematic view, in perspective, with some parts enlarged and some parts removed for clarity, of a preferred embodiment of an equipped floor in accordance with the present invention, forming part of a gym.

Number 1 in FIG. 1 indicates as a whole a gym, which has a floor 2 defined on top by a substantially horizontal upper surface 3, and is used for group fitness lessons in which a group of members 4 perform an exercise program under the guidance and supervision of an instructor 5.

Gym 1 is used for different types of fitness lessons, each of which may call for either a specific type of exercise fixture 6, or for a specific layout of exercise fixtures 6 on surface 3.

In the FIG. 1 embodiment, gym 1 is equipped with different types of exercise fixtures 6: treadmills 6*a*, exercise bikes 6*b*, and steppers 6*c*.

Each treadmill 6*a* is housed inside a portion 7*a* of a substantially parallelepiped-shaped cavity 7, which is formed in floor 2, beneath surface 3, is upwardly concave, and opens outwards at an opening 8 in surface 3. Cavity 7 is defined by two parallel major lateral walls 9, two parallel minor lateral walls 10 perpendicular to walls 9, and a bottom wall 11 parallel to surface 3 and perpendicular to walls 9 and 10.

Figure 2:
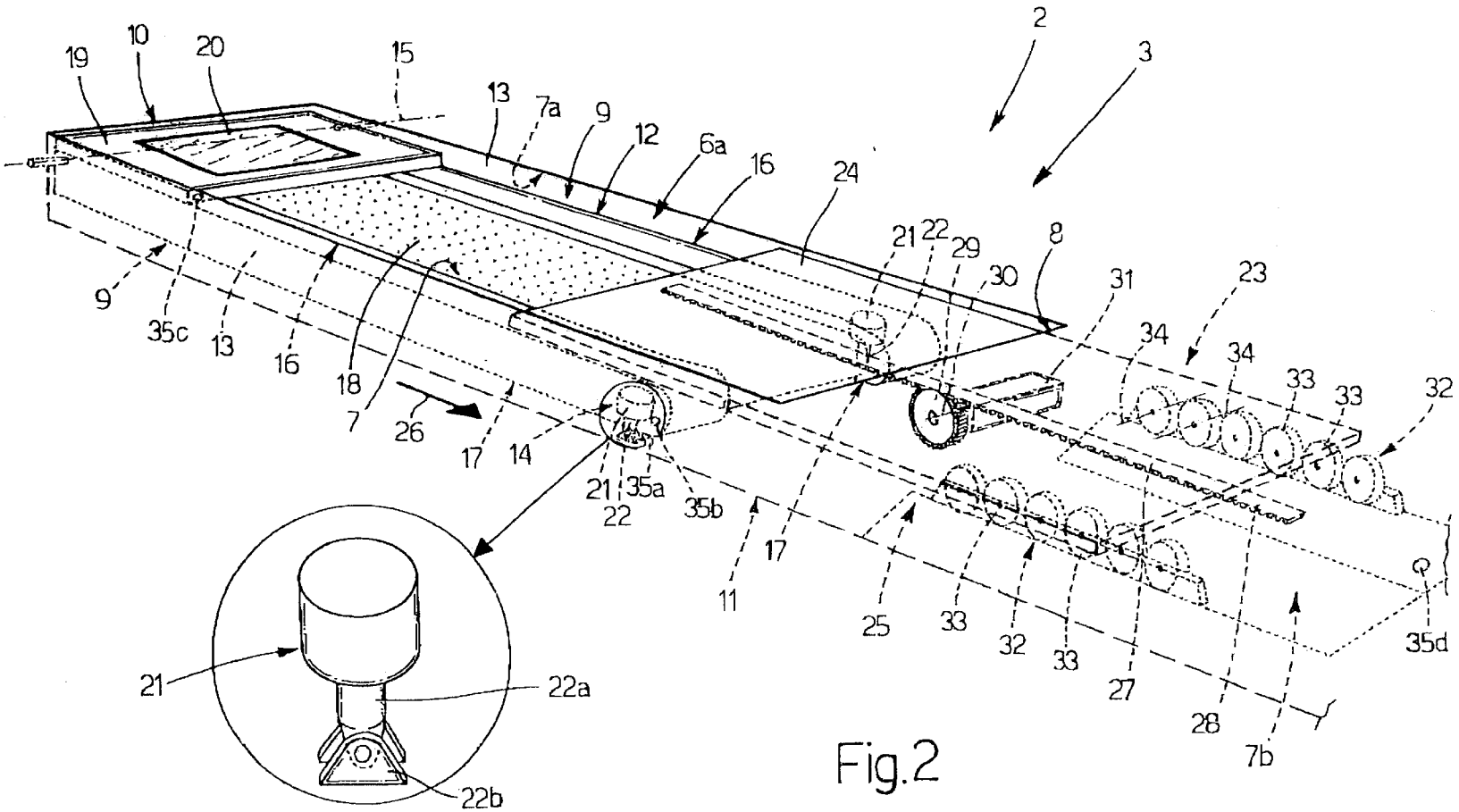
FIG. 2 shows a schematic view in perspective of a detail in FIG. 1.

With reference to FIG. 2, treadmill 6*a* is a known type and comprises a supporting frame 12 in turn comprising two substantially parallel elongated sides 13 hinged to floor 2 so as to swing, with respect to floor 2 and by virtue of an actuating device 14, about a hinge axis 15 perpendicular to walls 9. More specifically, the two sides 13 are defined at the top by respective coplanar surfaces 16, and at the bottom by respective coplanar surfaces 17 parallel to surfaces 16.

Treadmill 6*a* also comprises a conveyor belt 18 located between sides 13 and looped about two pulleys (not shown, and one of which is powered) fitted between sides 13 to rotate continuously about respective axes substantially parallel to axis 15. Treadmill 6*a* also comprises a substantially rectangular plate 19 extending between and along part of the length of sides 13, and having a display 20 connected to a computer (not shown) for controlling operation of treadmill 6*a*.

Figure 3A:
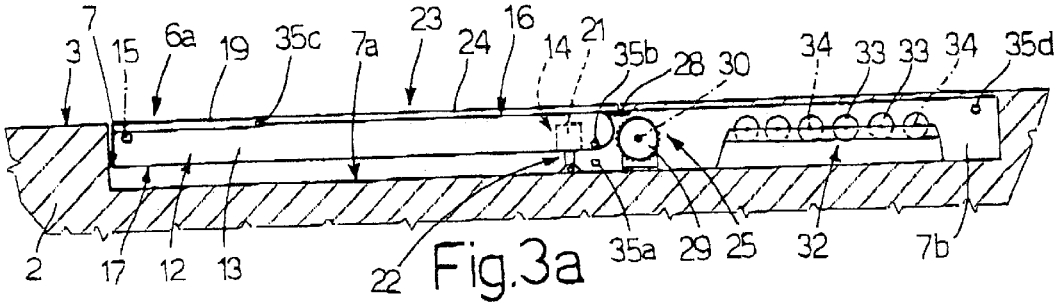
FIG. 3 shows a schematic side view, with parts removed for clarity, of the FIG. 2 detail, in four different operating positions.
Figure 3B:
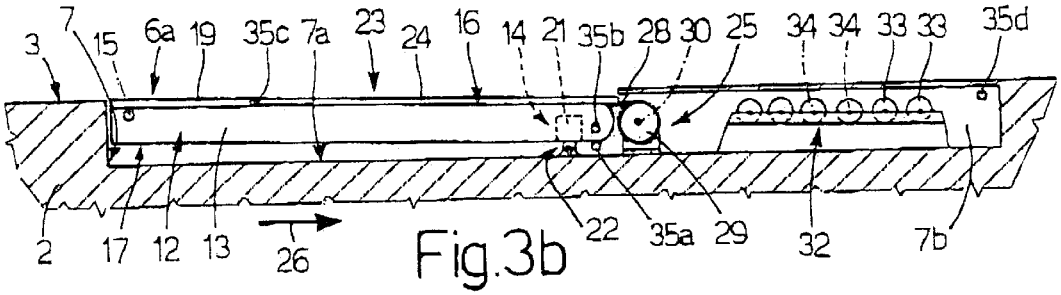
Figure 3C:
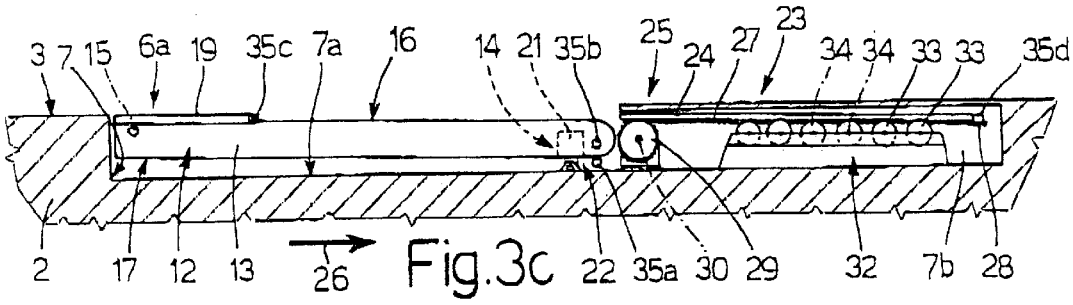
Figure 3D:
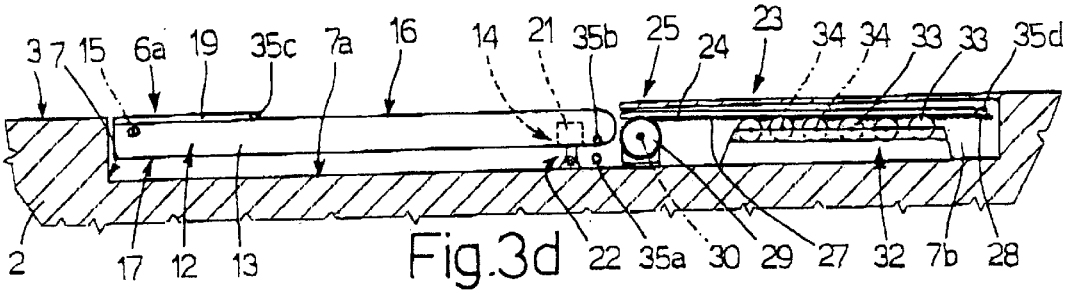

Device 14 comprises two actuating cylinders 21, each of which is housed inside one of sides 13 and has an output rod 22 which is movable between a withdrawn position (FIGS. 3*b* and 3*c*) and an extracted position (FIGS. 3*a* and 3*d*) to move treadmill 6*a* between a lowered position (FIGS. 3*b* and 3*c*) and a raised position (FIGS. 3*a* and 3*d*) in which plate 19 is substantially coplanar with surface 3.

Each rod 22 comprises a top portion (hereinafter indicated 22*a*) mounted to slide along respective cylinder 21 and perpendicularly to respective surface 17; and a bottom portion (hereinafter indicated 22*b*), a first end of which is hinged to respective portion 22*a*, and a second end of which is positioned contacting wall 11.

Treadmill 6*a* also has a device 23 for covering opening 8 and comprising a parallelepiped-shaped panel 24, which is substantially the same thickness as plate 19, is substantially the same width as opening 8, both measured parallel to axis 15, and is of a length, measured crosswise to axis 15, substantially equal to the difference between the lengths, also measured crosswise to axis 15, of opening 8 and plate 19.

Device 23 also comprises an actuating device 25 for moving panel 24 (as explained later on) along surfaces 16 of sides 13 in a direction 26 crosswise to axis 15, and between a work position (FIGS. 3*a* and 3*b*) in which panel 24 is positioned contacting plate 19 and over belt 18, and a rest position (FIGS. 3*c* and 3*d*) in which panel 24 is housed inside a portion 7*b* of cavity 7 adjacent to portion 7*a*.

Device 25 comprises a rack 27, which is fitted to a bottom surface of panel 24, is positioned facing belt 18, extends between and parallel to sides 13, and has an end portion 28 projecting from panel 24 towards portion 7*b*. To move panel 24 between the work and rest positions along sides 13, rack 27 (as explained later on) meshes with a pinion 29 housed inside portion 7*b* and rotated by a motor 31 about a respective axis 30 parallel to axis 15.

Device 25 also comprises two sets 32 of rollers 33 housed inside portion 7*b* on opposite sides of rack 27. The rollers 33 in each set 32 are mounted to rotate about respective axes 34 parallel to axes 15 and 30, and are aligned with one another in direction 26 to guide panel 24 between the work and rest positions.

Cavity 7 is provided with a number of sensors 35: one, hereinafter indicated 35*a*, for detecting the lowered position of treadmill 6*a*; one, hereinafter indicated 35*b*, for detecting the raised position of treadmill 6*a*; one, hereinafter indicated 35*c*, for detecting the work position of panel 24; and one, hereinafter indicated 35*d*, for detecting the rest position of panel 24.

Operation of gym 1 will now be described with reference to FIG. 3 and one cavity 7, and as of the instant (FIG. 3*a*) in which treadmill 6*a* is in the raised position, and panel 24 is in the work position, i.e. closing cavity 7.

At this point, treadmill 6*a* is moved into the lowered position (FIG. 3*b*) by means of the two cylinders 21, so that panel 24 is parallel to direction 26 and the end portion 28 of rack 27 meshes with pinion 29. In this connection, it should be pointed out that, since portions 22*b* of the two actuating cylinders 21 are hinged to respective portions 22*a*, the free ends of the two portions 22*b* remain contacting bottom wall 11 of cavity 7.

By means of actuating device 25, panel 24 is then moved in direction 26 into the rest position (FIG. 3*c*), i.e. to open cavity 7; and, finally, treadmill 6*a* is moved back into the raised position (FIG. 3*d*) for use by one of the members 4 in the fitness lesson group.

In a variation not shown, cavities 7 may be formed to house exercise fixtures 6 other than treadmills 6*a*.

In a further variation not shown, each exercise fixture 6 may be moved perpendicularly to wall 11 between a raised position in which exercise fixture 6 is located substantially outside cavity 7, and a lowered position in which exercise fixture 6 is substantially housed inside cavity 7.

By housing treadmills 6*a* inside respective cavities 7, exercise fixtures 6 can be changed over relatively quickly to equip gym 1 for the next lesson, and only a relatively small portion of gym 1 is required for storing the unused exercise fixtures 6. Moreover, when treadmills 6*a* and respective panels 24 are positioned closing respective cavities 7, a relatively large portion of gym 1 is left available for actual use.

What is claimed is:

1. An exercise floor for housing and supporting exercise equipment which comprises:

a floor member;

at least one cavity provided in the floor member, which opens outwards, for housing at least one exercise fixture, which is a treadmill;

a covering means movable between a closed and an open position for closing and opening said cavity, said covering means being supported by said treadmill when in the closed position.

2. The exercise floor as claimed in claim 1, wherein, when said covering means are in the open position, said covering means are located substantially underneath said floor; and, when said covering means are in the closed position, said covering means are substantially coplanar with the floor.

3. The excercise floor as claimed in claim 1, further comprising actuating means for moving said covering means between said closed position and said open position.

4. The exercise floor as claimed in claim 3, wherein said cavity opens outwards at an opening; said actuating means comprising a first actuating means for moving said covering means between said closed position and a lowered position wherein the covering means are located substantially beneath the floor; and a second actuating means for moving said covering means between the lowered position and the open position wherein the covering means are located to the side of said opening.

5. The exercise floor as claimed in claim 4, further comprising detecting means for detecting said closed, open and lowered positions of said covering means.

6. The exercise floor as claimed in claim 1, further comprising additional actuating means for moving the exercise fixture to and from a raised position wherein the exercise fixture is substantially outside of said cavity.

7. The exercise floor as claimed in claim 1, wherein said treadmill comprises a conveyor belt; a frame for supporting the conveyor belt and at least one substantially flat portion having a display; said flat portion being substantially coplanar with the floor at least when said covering means are in the closed position.

8. A gym comprising at least one equipped floor as claimed in claim 1.

* * * * *

UNITED STATES PATENT AND TRADEMARK OFFICE

CERTIFICATE OF CORRECTION

PATENT NO. : 6,601,358 B2
DATED : August 5, 2003
INVENTOR(S) : Panatta

It is certified that error appears in the above-identified patent and that said Letters Patent is hereby corrected as shown below:

Title page,
Item [30], Foreign Application Priority Data, please correct to -- BO00A0353 --

Signed and Sealed this

Twenty-second Day of June, 2004

JON W. DUDAS
*Acting Director of the United States Patent and Trademark Office*